US005228698A

United States Patent [19]

Dubarry, Jr.

[11] Patent Number: 5,228,698

[45] Date of Patent: Jul. 20, 1993

[54] CASINO BOARD GAME APPARATUS

[76] Inventor: A. P. Dubarry, Jr., 4514 Charmion La., Encino, Calif. 91316

[21] Appl. No.: 970,872

[22] Filed: Nov. 3, 1992

[51] Int. Cl.[5] ..... A63F 3/09

[52] U.S. Cl. ..... 273/256; 273/274

[58] Field of Search ..... 273/242, 243, 256, 274, 273/278

[56] References Cited

U.S. PATENT DOCUMENTS

| | | | |
|---|---|---|---|
| 3,889,954 | 6/1975 | Malisow | 273/274 X |
| 4,890,843 | 1/1990 | Chauve | 273/274 X |
| 4,921,249 | 5/1990 | Kropkowski et al. | 273/274 X |
| 4,930,789 | 6/1990 | Harris et al. | 273/274 X |
| 5,169,154 | 12/1992 | Borghi | 273/274 X |

FOREIGN PATENT DOCUMENTS

| | | | |
|---|---|---|---|
| 2648356 | 12/1990 | France | 273/274 |
| 3755 | 8/1909 | United Kingdom | 273/274 |

*Primary Examiner*—William Stoll

*Attorney, Agent, or Firm*—Rapkin, Gitlin & Moser

[57] ABSTRACT

A board game that educates and informs the players specifically about the various techniques and skills involved with certain games of chance and generally, about the gambling businesses currently operating in cities like Las Vegas, Nev. The game board is provided with two principal areas, including an outer board section and an inner board section. The outer section consists of a plurality of consecutive spaces situated around the periphery of the board forming a path of travel for each player's movable piece. Most of these spaces represent a particular casino currently operating in Las Vegas, Nev. A few of these spaces are designated with indicia that directs a player to act according to the instructions or graphical depictions thereon. The inner board section comprises a simulated roulette wheel with a spinner situated in the center. Around the spinner are formed a plurality of individual numbers in a circular arrangement and a series of example poker hands surrounding the numbers. Also located within the inner board section are a plurality of spaces upon which there are placed various stacks of cards and poker chips that are employed in the game.

4 Claims, 2 Drawing Sheets

CASINO BOARD GAME APPARATUS

BACKGROUND OF THE INVENTION

1. Field of the Invention

This invention relates to the field of games of the types that are intended to be played by a plurality of players on a board with the winner determined by the player at the conclusion of the game who has accumulated the highest amount of value measured in properties and gambling chips of various denominations.

2. Description of the Prior Art

Board games, such as the popular "Monopoly", are well known in the prior art. The object of "Monopoly" is to accumulate as much of the fictitious real estate and other commercial properties and play money as possible to be determined the winner. This objective is achieved, in part, by the chance movement of playing pieces around the board. "Monopoly" is popular because it relates to something that exists in the real world, namely many of the streets and places in and around Atlantic City, N.J. and surrounding communities. The game is also fun and interesting because it simulates the actual financial situations that are often involved with the purchase, sale and mortgaging of real estate. And though the winner is often determined by luck alone, the proper management of money and properties that a player owns will maximize a player's opportunity for victory.

Despite their relative popularity, "Monopoly" and the other games that have been developed since then that employ similar procedures and objectives, are limited in the scope of their informational value, as most games usually are.

Though games involving chance are not new, a board game based upon the subject of the "capital" of gambling, to wit: Las Vegas, Nev., is new. Neither "Monopoly" nor any of the subsequently developed games that employ similar procedures and objectives offer the opportunities to learn about the various gambling casinos that exist today in the City of Las Vegas. Also, these prior art games do not serve to inform and educate people on the various aspects and techniques of gambling as a recreational activity. This, together with the requirement of the present invention that the players understand mathematics and learn to properly manage their gambling proceeds and business properties, provide the kind of challenge and objectives not known heretofore in the prior art.

Accordingly, there has existed before now a need to provide a game that combines the foregoing features to enable a person to learn about the various gambling businesses of Las Vegas as well as the various techniques associated with the art and skill of recreational gambling and money management.

SUMMARY OF THE INVENTION

The present invention provides the means to play a game that educates and informs the players specifically about the various techniques and skills involved with certain games of chance and generally, about the gambling businesses currently operating in cities like Las Vegas, Nev. The present invention also encourages the participants to learn to efficiently manage business properties and gambling proceeds in the form of valuable poker chips with the ultimate goal of winning the game.

A single game board is provided with two principal areas, including an outer board section and an inner board section. The outer section consists of a plurality of consecutive spaces situated around the periphery of the board forming a path of travel for each player's movable piece. Most of these spaces represent a particular casino currently operating in Las Vegas, Nev. A few of these spaces are designated with indicia that directs a player to act according to the instructions or graphical depictions thereon. The inner board section comprises a simulated roulette wheel with a spinner situated in the center. Around the spinner are formed a plurality of individual numbers in a circular arrangement and a series of example poker hands surrounding the numbers. Also located within the inner board section are a plurality of spaces upon which there are placed various stacks of cards and poker chips that are employed in the game.

The number of spaces traveled by a player's movable piece is determined by a chance element provided in the form of dice. Each player begins the game with a predetermined number of miniature poker chips, which are colored to denote their various denominations. A predetermined number of chips is also placed upon a space within the inner board section called the Cashier's Cage and maintained at a minimum amount there throughout the game. The players begin on the Start space and move their playing pieces along the path of travel according to the number shown on the dice. Depending upon the throw of the dice, a player either (1) may elect to purchase a casino using the chips he has accumulated or receive one Casino Card free; (2) must select a card from one of the various card groups positioned on the game board (e.g. a Players Card or a Craps Card) and then follow the instructions or perform according to the consequences thereon; or (3) pay a guest fee to the owner of the casino landed on, if that casino is owned by another player.

Among the consecutive spaces situated along the board's periphery are a plurality of spaces entitled Craps Card, a Comp Card space, a Start space and a Free Spin space. When a player's piece lands on a Comp Card space, the player receives a Comp Card which he may then use immediately or in the future to invalidate or offset a single Craps Card. When a player's piece lands on a Craps Card space, that player must draw a Craps Card and then acts according to the consequences thereon. The Free Spin space entitles the player to a Free Spin on the roulette wheel. Instructions shown on the Players Cards either direct a player to wager his chips according to the outcome of the throw of the dice or direct the player to use the roulette wheel and wager a bet according to the outcome determined by the number or poker hand the spinner arrow eventually points to after the arrow stops spinning.

The object of the game is for a player to have accumulated the highest net worth when the game concludes. Net worth is calculated according to the number and denominations of the chips each player has at the end of the game as well as the number of casinos each player owns at that point.

DETAILED DESCRIPTION OF THE PREFERRED EMBODIMENT

Figures 1, 2:
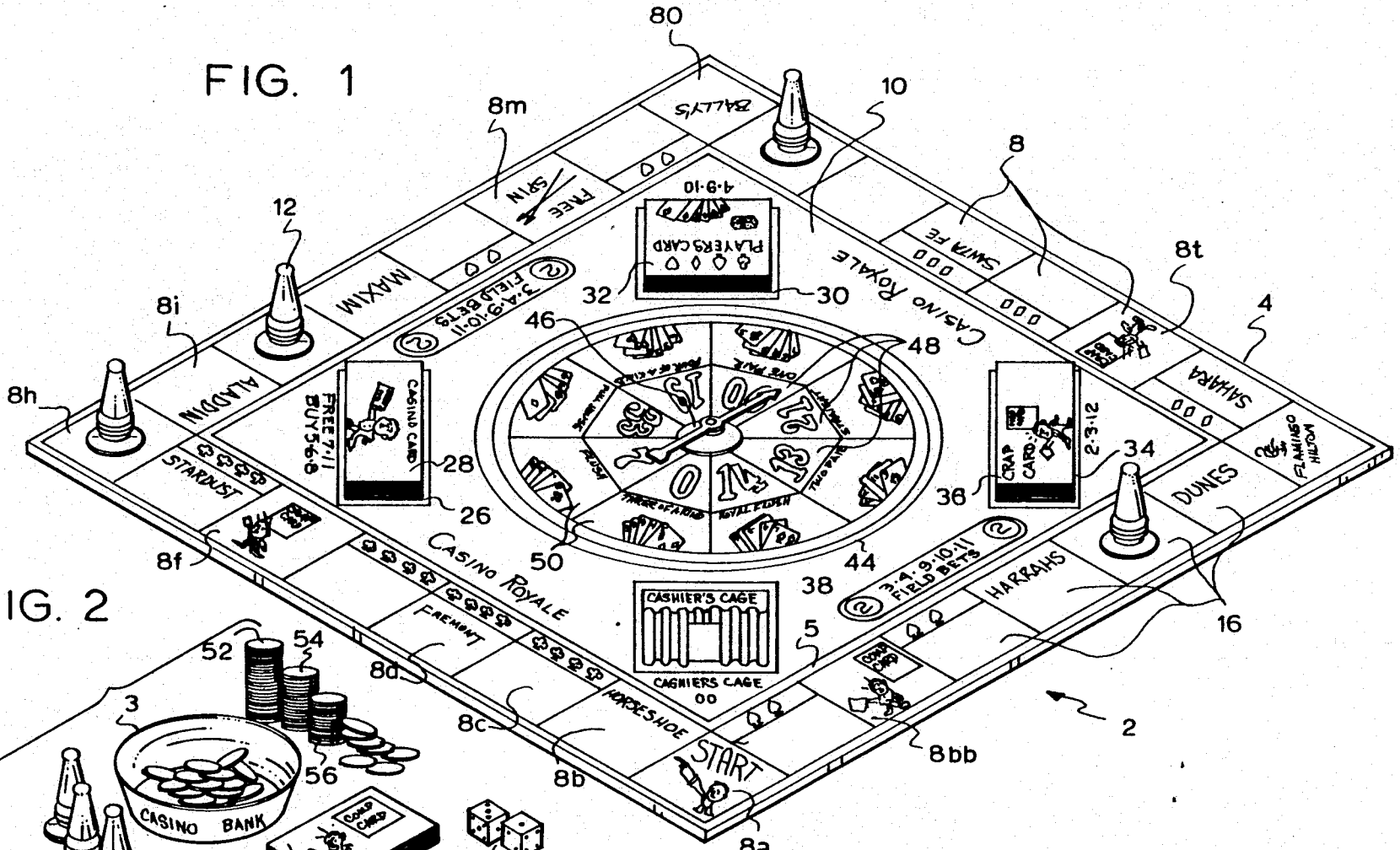
FIG. 1 is a perspective of the game board of the present invention.
FIG. 2 comprises selected examples of the various game components used to play the board game of the present invention.
Figure 3:
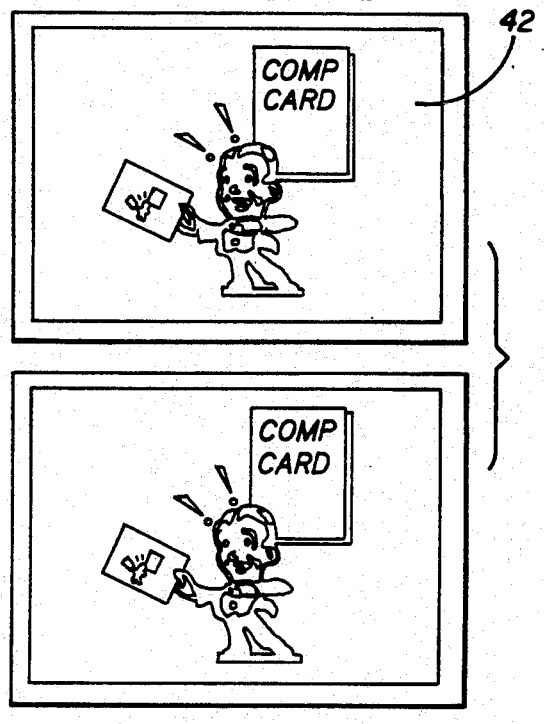
FIG. 3 comprises an example of a Comp Card, depicting the front and the back side, in accordance with the board game of the present invention.
Figure 5:
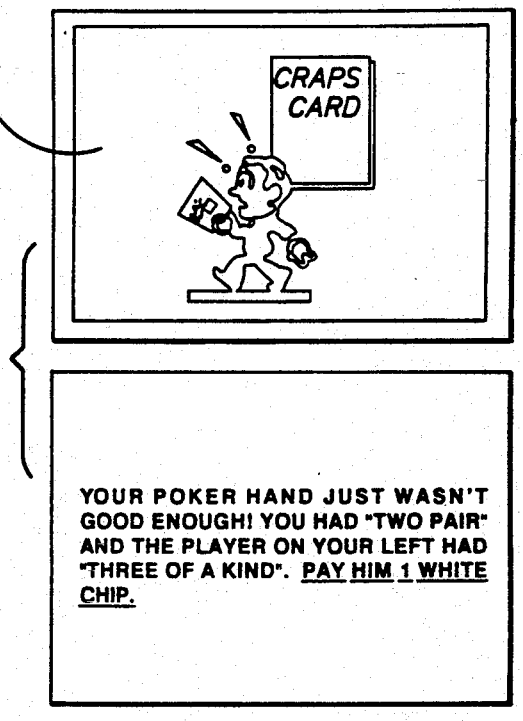
FIG. 5 is an example of a Craps Card, depicting the front and the back side, in accordance with the board game of the present invention.
Figure 4:
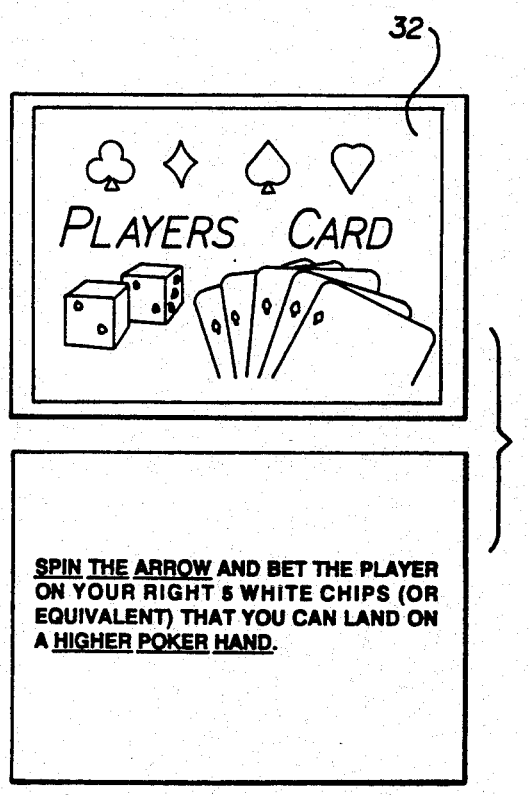
FIG. 4 is an example of a Players Card, depicting the front and the back side, in accordance with the board game of the present invention.
Figure 6:
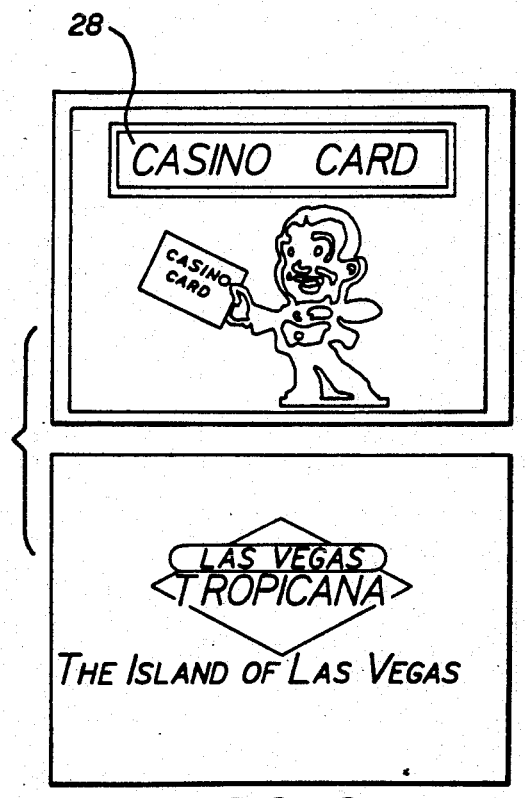
FIG. 6 is an example of a Casino Card, depicting the front and the back side, in accordance with the board game of the present invention.

Referring to the drawing, the game board is denoted generally as 2 and is divided into two principal areas, an outer board section 4 and an inner board section 10. Outer board section 4 defines a series of square or rectangular shaped spaces designated generally as 8 and specifically as 8*a*, 8*b*, 8*c*, etc. Illustrated on the large majority of these spaces are the names or names and logos of a plurality of well known casinos in Las Vegas, Nev., designated generally as 16. Included among these, are Sam Boyd's Fremont Hotel and Casino denoted as 8*d*, the New Aladdin Hotel and Casino denoted as 8*i*, Gold Coast denoted as 81 and Bally's Casino Resort denoted as 8*o*. Interspersed among the spaces 8 are a variety of additional spaces, including Start space 8*a*, Craps Card spaces 8*f* and 8*t*, Comp Card space 8*bb* and Free Spin space 8*m*. Spaces 8 taken together form a continuous path of travel for a player's movable piece or marker 12.

Inner board section 10 includes a space 26 for a stack of Casino Cards 28, a space 30 for a stack of Players Cards 32, a space 34 for a stack of Craps Cards 36, a space 38 for the Cashier's Cage and a space 40 for a stack of Comp Cards 42. In the center area of inner board section 10 is a roulette wheel 44 comprised of a series of numbers 48 surrounded by a series of illustrated example poker hands 50 all formed around a spinner 46, which rests upon space 47 located in the approximate geographic center of the board 2.

Below the bottom edge of space 26 is the designation "FREE 7-11" and below that the designation "BUY 5.6.8.". Below the bottom edge of space 30 are the numbers "4.9.10". Below the bottom edge of space 34 are the numbers "2.3.12". Below the bottom edge of space 38 is the designation "CASHIER'S CAGE" and below that the number "00". Along the outer perimeter 5 of the inner board section 10 at opposite sides thereof are the numbers "2.3.4.9.10.11.12" and below that the words "FIELD BETS".

Colored poker chips are used in lieu of money to play the game. White Chip 52 has a value of one unit. Red Chip 54 has a value of five units. Blue Chip 56 has a value of ten units. Each casino has a value of six units for purposes of net worth computations at the end of the game. Markers 12 are used by each player to move about the board according to the throw of the dice 14.

With the obvious exception of board 2, all playing pieces, cards, etc. are stored in a container 3, which is also used as the Casino Bank for holding and distributing the chips 52, 54 and 56 during the game. At the start of the game, board 2 is unfolded and laid flat. Spinner 46 is placed on space 47. A stack of Casino Cards 28 is placed on space 26; a stack of Players Cards 32 is placed on space 30; a stack of Craps Cards 36 is placed on space 34; a stack of Comp Cards 42 is placed near Casino Bank 3.

The player located to the left of the Start space 8*a* is automatically designated the Banker. The Banker's first duty is to distribute the requisite number and denominations of poker chips. At the beginning of the game each player receives five White Chips 52, three Red Chips 54 and three Blue Chips 56. The Banker also places five White Chips 52 or one Red Chip 54 on the Cashier's Cage 38 and, when necessary throughout the game, is responsible for replacing these chips to maintain the required minimum.

Each player then selects a marker 12, which is placed on the Start space 8*a*. The Banker begins by rolling the dice 14 and moving his marker 12 around the spaces 8 to the specific space corresponding to the number shown on the dice 14. If the combined total of the dice 14 is 7 or 11, the marker 12 is moved along the spaces 8 to the 7th or 11th space hence. If a casino space 16 is landed on e.g. space 8*h*-the Tropicana, and the casino designated thereon is not owned by another player, then the player landing on that space receives the corresponding Casino Card free. That player is also entitled to a Free Spin at the roulette wheel 44. If the spinner 46 stops at "00", the player wins all the chips accumulated to that point in the Cashier's Cage 38.

If the combined total shown on the dice 14 is "5,6 or 8", the marker 12 is moved along the spaces 8 to the 5th, 6th or 8th space hence. If the space landed on represents a casino not yet owned by another player, that player may, at his option, purchase the corresponding Casino Card for six units, i.e. either six White Chips 52 or one Red Chip 54 and one White Chip 52. If this occurs, the Banker receives the chips and deposits three of them into the Casino Bank 3 and three of them in the Cashier's Cage 38. The Banker then gives the player purchasing that casino the corresponding Casino Card drawn from the stack of Casino Cards 28. Throughout the game, whenever a casino is purchased for six White Chips 52, three of the chips are deposited in the Casino Bank 3 and the balance are always deposited in the Cashier's Cage 38.

If the combined total shown on the dice 14 is "2,3 or 12", the player will move his marker 12 along the spaces 8 to the 2nd, 3rd or 12th space hence and, despite the character of the space he lands on, the player must then draw from the stack of Craps Cards 36 and follow the instructions on the back of the specific card selected. If the player should land on one of the designated Craps Cards spaces, e.g. 8*f* or 8*t*, after having rolled either a "2, 3, or 12", the player must then draw from the stack of Craps Cards 36 and suffer the consequences of two individual Craps Cards. Craps Cards 36 each contains a brief description of events on the back relating an unfortunate experience befalling that particular player and the corresponding consequence. For example, one such card describes how the player's ex-wife was just awarded a certain number of that player's chips and one of his casinos in a divorce proceeding. The player is then directed to satisfy the award by giving the chips and the corresponding Casino Card to a female player or, if no female is playing the game at the time, then depositing the chips into the Cashier's Cage 38. Another example describes a situation where the player has just lost a poker hand and is required, as a consequence of that loss, to pay one White Chip 52 to the player on his left. When a player lands on a Comp Card space, e.g. 8*bb*, that player is entitled to receive a Comp Card 42 from the Casino Bank 3. A single Comp Card 42 may be used to offset the consequences of an individual Craps Card 36. When this occurs, the Comp Card 42 must immediately be returned to the Casino Bank 3. In this manner, a Comp Card may only be used once. Comp Cards 42 may also be sold to the highest bidder among the other players.

If the combined total shown on the dice 14 is "4, 9 or 10", the player moves his marker 12 to the 4th, 9th or 10th space hence and is then required to draw from the stack of Players Card 32. The back of each of the Players Cards 32 directs the player to wager a certain number of chips with the result of the wager depending on the outcome of the roll of the dice 14 or the spin of the roulette wheel 44. Examples include a card that directs the player to rotate the spinner 46 after wagering the player, to his right five White Chips 52 that the arrow, when it stops spinning, will point to a higher poker hand 50. Another example includes a Players Card 32 that directs the player to roll the dice 14 and wager a certain amount of White Chips 52 with the player on his right that he can roll a lower number than the other player. Whenever a card is drawn from one of the card stacks on the game board 2, and the card's directions are followed by that player, the card is then placed at the bottom of the stack from which it was drawn.

If a player's marker 12 lands on the Free Spin space 8*m*, that player is entitled to spin the roulette spinner 46 once. If the point of the spinner 46 stops on "00", the player wins all of the chips in the Cashier's Cage 38.

During the game, whenever a player's marker 12 lands on a space corresponding to a casino owned by another player, the player landing on the space must pay the other player according to the following rules:

If the Casino space 16 does not display any suit indicia (e.g. a diamond, heart, club or spade) or, if displaying a particular suit indicia, the corresponding casino is owned by a player who does not own another casino displaying a matching suit indicia, the guest fee payable to the other player is only three White Chips 52. This is known as a Single Casino.

If the Casino space 16 landed on displays one particular suit and the owner of the corresponding casino also owns another casino with a space 16 displaying the same suit, then the guest fee is six White Chips 52 or the equivalent in White Chips 52 and Red Chips 54. This is known as a Double Casino.

If the Casino space 16 landed on displays either a diamond or a club suit and the owner of the corresponding casino also owns two other casinos with corresponding spaces 16 displaying the same suit, then the guest fee payable to the player owning the casino is nine White Chips 52 or the equivalent in White Chips 52 and Red Chips 54. This is known as a Triple Royale.

If the Casino space 16 landed on displays a club suit and the owner of that casino also owns three other casinos with spaces 16 displaying the identical suit, then the guest fee payable to the player owning the casino is twelve White Chips 52 or the equivalent in White Chips 52 and Red Chips 54. This is known as a Casino Royale.

A player is permitted at any time during the game to either mortgage or sell one or more of his casinos to raise the chips to enable him to continue to play. If the player's choice is to mortgage, then he will receive three White Chips 52 from the Casino Bank 3 in exchange for the mortgaged casino. If the player's choice is to sell, he may sell one or more of his casinos to the highest bidder among the other players. Before a player may purchase any additional casinos, however, that player must first repurchase the mortgaged casino(s) from the Casino Bank 3.

A doubles roll of the dice 14 automatically entitles a player to a second roll. A maximum of three consecutive such rolls will be permitted.

If, during the course of the game, one or more players lands on the Start space 8*a*, so long as there are any markers 12 remaining on that space, the purchase price of all casinos is doubled to twelve White Chips 52 or their equivalent, all wagers indicated on the Players Cards 32 are doubled and all consequences indicated on the Craps Cards 26 are doubled. Whenever a player passes the Start space 8*a* during the game, that player receives a bonus of five White Chips 52 or their equivalent from the Casino Bank 3.

In the event a player has no more poker chips remaining, or owns no casinos or Comp Cards, he is immediately declared bankrupt and is automatically eliminated from any further game play.

Game play always moves in a clockwise direction and will continue until time expires or the players decide on their own to stop. The player with the highest amount of net worth at the end wins.

While the game has been shown and described in detail, it is obvious that this invention is not to be considered as being limited to the exact form disclosed, and that changes in detail and construction of the various aspects of the game may be made therein within the scope of the invention without departing from the spirit thereof.

I claim:

1. A board game apparatus for play by two or more players comprising:

a plurality of playing pieces, at least one of said pieces to be provided to and controlled by each player during a given turn;

means for each player, when it is said player's turn, to develop by chance a numerical factor;

a game board defining a playing surface substrate;

a playing surface supported by the substrate, said playing surface having distinguishing markings thereon including;

an outer board area, said outer board area having defined around the periphery thereof a plurality of consecutive first spaces with indicia thereon constituting a path of travel for said playing pieces, said indicia including the name or name and logo of a particular gambling casino, or the designation Start, Free Spin, Comp Card or Craps Card, the number of spaces to be traveled by each playing piece being determined by the numerical factor developed by such a player, when it is said player's turn, upon using said means to develop said numerical factor;

an inner board area, said inner board area having thereon a plurality of second spaces, each of said second spaces being provided for a stack of cards that may be drawn by a player during the game, said second spaces including the designations Casino Card, Players Card, Craps Card and Cashier's Cage, and a roulette wheel, said roulette wheel including a spinner element in the approximate center thereof and a graphic configuration around the spinner element having a plurality of indicia thereon comprising a series of numbers and adjacent to and surrounding said series of numbers a series of example poker hands;

a plurality of Casino Cards, each of said Casino Cards having either a name or a name and logo of a particular gambling casino depicted on the back thereof and representing ownership of that casino;

a plurality of Players Cards, each of said Players Cards having instructions on the back thereof directing the player drawing said card to place a wager with the outcome to be determined by the means to develop said numerical factor or a spin of the roulette wheel;

a plurality of Craps Cards, each of said Craps Cards providing information on the back thereof regarding an unfortunate circumstance befalling the player that draws the card and the resulting negative consequence thereof;

a plurality of Comp Cards, each of said Comp Cards to be held for immediate or future use to invalidate or offset the effect of a single Craps Card; and a plurality of playing chips in various denominations.

2. The game board invention of claim 1 wherein said means to develop by chance a numerical factor comprises dice.

3. The game board invention of claim 1 wherein said playing chips vary in color and each color denotes a different denominational unit.

4. The game board invention of claim 1 wherein said playing chips are held in and distributed from a bank depository throughout the course of the game.

* * * * *